United States Patent [19]

Reid

[11] Patent Number: 4,724,064

[45] Date of Patent: Feb. 9, 1988

[54] COMPOSITION AND METHOD FOR COKE RETARDANT DURING HYDROCARBON PROCESSING

[75] Inventor: Dwight K. Reid, Houston, Tex.

[73] Assignee: Betz Laboratories, Inc., Trevose, Pa.

[21] Appl. No.: 553,008

[22] Filed: Nov. 17, 1983

[51] Int. Cl.[4] ..... C10G 9/12; C10G 9/16

[52] U.S. Cl. ..... 208/48 R; 208/48 AA; 208/131; 208/50; 585/950; 252/389.4

[58] Field of Search ..... 208/48 R, 131, 48 AA, 208/182, 50; 423/276, 277, 279; 585/950; 252/289.4

[56] References Cited

U.S. PATENT DOCUMENTS

| | | | |
|---|---|---|---|
| 1,847,095 | 3/1932 | Mittasch et al. | 208/48 R |
| 2,063,596 | 12/1936 | Feiler | 208/48 R |
| 3,328,119 | 6/1967 | Robson | 423/277 |
| 3,381,051 | 4/1968 | Bergier et al. | 208/48 R |
| 3,507,929 | 4/1970 | Happel et al. | 585/950 |
| 3,531,394 | 9/1970 | Koszman | 208/48 R |
| 3,536,776 | 10/1970 | Neng | 208/48 R |
| 3,687,840 | 8/1972 | Sze et al. | 208/50 |
| 3,876,527 | 4/1975 | Dugan et al. | 585/950 |
| 3,948,759 | 4/1976 | King et al. | 208/131 |
| 4,105,540 | 8/1978 | Weinland | 208/348 |
| 4,116,812 | 9/1978 | Godar et al. | 208/48 AA |
| 4,119,552 | 10/1978 | Davis et al. | 252/49.6 |
| 4,331,545 | 5/1982 | Papay et al. | 252/49.6 |
| 4,331,641 | 5/1982 | Hinnenenkamp et al. | 423/277 |
| 4,376,712 | 3/1983 | Horodysky et al. | 252/49.6 |
| 4,404,087 | 9/1983 | Reed et al. | 208/48 R |
| 4,412,928 | 11/1983 | Holstedt et al. | 252/49.6 |
| 4,427,560 | 1/1984 | Holstedt et al. | 252/49.6 |
| 4,555,326 | 11/1985 | Reid | 208/48 R |

FOREIGN PATENT DOCUMENTS

| | | | |
|---|---|---|---|
| 2545296 | 4/1976 | Fed. Rep. of Germany | 208/131 |
| 275662 | 8/1928 | United Kingdom | 208/48 R |
| 296752 | 9/1928 | United Kingdom | 585/950 |

OTHER PUBLICATIONS

French Patent 2202930, (Chem. Abstracts, vol. 83, 30687k).

Starshov et al., Irv Vyssh. Ucheb., Neft 6A2, 1977, (Chem. Abs., vol. 87:154474r).

Nikonov et al., USSR, 834107, 1981, (Chem. Abstract, 95:135651r).

Starshov et al., Nftekhimiya, 1979, (Chem. Abst. 92:8645j).

*Primary Examiner*—Helen M. S. Sneed

*Assistant Examiner*—Helane Myers

*Attorney, Agent, or Firm*—Alexander D. Ricci; Bruce E. Peacock

[57] ABSTRACT

The present disclosure is directed to methods and compositions for controlling undesirable coke formation and deposition commonly encountered during the high temperature processing of hydrocarbons. During the processing of hydrocarbon, coke formation and, in particular, filamentous coke formation can be inhibited by adding a sufficient amount of a boron compound from the group of metal borides, boron oxide compounds, and boric acid which is substantially free of water. The boron oxide compounds are particularly effective, especially when utilized in a non-polar organic liquid carrier.

29 Claims, No Drawings

COMPOSITION AND METHOD FOR COKE RETARDANT DURING HYDROCARBON PROCESSING

BACKGROUND OF THE INVENTION

The present invention is directed to a method and composition for use in inhibiting the formation and deposition of coke on surfaces during the elevated tempature processing of hydrocarbons. Coke disposition is generally experienced when hydrocarbon liquids and vapors contact the hot metal surfaces of the processing equipment. While perhaps not entirely technically understood, because of the complex makeup of the hydrocarbons upon elevated temperatures and contact with hot metallic surfaces, the hydrocarbons undergo various changes through either chemical reactions and/or decomposition of various unstable components of the hydrocarbon. The undesired products in many instances include coke, polymerized products, deposited impurities and the like. Whatever the undesired product that may be formed, the result is the same, i.e., reduced economies of the process. If these deposits are allowed to remain unchecked, heat transfer, throughput and overall productivity are detrimentally effected. Moreover, downtime is likely to be encountered due to the necessity of either replacing and/or cleaning of the affected parts of the processing system.

While the formation and type of undesired products are dependent upon the hydrocarbon being processed and the conditions of the processing, it may generally be stated that such products can be produced at temperatures as low as 100° F. but are more prone to formation as the temperature of the processing system and the hydrocarbon reach levels of 600°–1300° F. At these temperatures, coke formation is likely to be produced regardless of the type hydrocarbon being charged. The type coke formed, i.e., amorphous, filamentous or pyrolytic, may vary somewhat; however, the probability of the formation of such is quite high.

As earlier stated the present invention is directed to methods and chemicals for use in the retardation of coke formation in the elevated temperature processes and also to the inhibition of deposition of the coke in the event it is actually formed.

The present invention is particularly effective in hydrocarbon processing systems where temperatures reach levels of 600° to 1300° F. where amorphous and filamentous coke are likely to be formed. Amorphous coke is generally produced in systems where temperatures are less than 850° F. This type coke generally is composed of low molecular weight polymers, has no definite structure and is sooty in nature. Above 850° F., filamentous coke is generally encountered. This type coke, as the name indicates, takes the form of filaments that appear in some cases like hollow tubes. As opposed to amorphous coke, filamentous coke is not sooty and is hard and graphitic in nature.

Amorphous and filamentous coke formation is customarily found in hydrocarbon processing systems such as delayed coking processes (temperature 900° to 1300° F.); platforming, catalytic reforming and magnaforming processes (900° F.); residue desulfurization processes (500° to 800° F.); hydrocracking processes (600°–1,100° F.), visbreaking processes (800°–1000° F.), cracking of chlorinated hydrocarbons, and other petrochemical intermediates at similar temperatures.

Pyrolytic coke is produced in olefin manufacture where pyrolyses of gaseous feed stocks (ethane, butane, propane, etc.) or liquid feed stocks (naphthas, kerosene, gas oil, etc.) are "cracked" by exposing such stocks to temperatures of from 1400° to 1700° F. to produce the desired olefin.

While various treatments have been proposed to eliminate or reduce filamentous coke formation at the 600° to 1300° F. temperatures, none have attained any great degree of success. In the book "Coke Formation on Metal Surfaces" by Albright and Baker, 1982, methods are described which utilize silicon and aluminum as pretreatments. In accordance with the procedure, the furnace tubes are pretreated with silicon and aluminum hours before introduction of the hydrocarbon feed stocks. With the use of silicon, furnace tubes are coated by the chemical vaporization of an alkoxysilane. While U.S. Pat. Nos. 4,105,540 and 4,116,812 are generally directed to fouling problems in general, the patents disclose the use of certain phosphate and phosphate and sulfur containing additives for use purportedly to reduce coke formation in addition to general foulants at high temperature processing conditions.

With respect to coke retardation in pyrolytic olefin production generally above 1400° F., various efforts have been reported, namely:

1. French Pat. No. 2,202,930 (Chem. Abstracts Vol. 83, 30687K) is directed to tubular furnace cracking of hydrocarbons where molten oxides or salts of group III, IV or VIII metals (e.g., molten lead containing a mixture of $K_3VO_4$, $SiO_2$ and NiO) are added to a pretested charge of, for example, naphtha/steam at 932° F. This treatment is stated as having reduced deposit and coke formation in the cracking section of the furnace.
2. Starshov et al, *Izv Vyssh. Uchebn. Zaved. Neft GAZ,* 1977 (Chem. Abst. Vol. 87: 154474r) describes the pyrolysis of hydrocarbons in the presence of aqueous solutions of boric acid. Carbon deposits were minimized by this process.
3. Nokonov et al., U.S.S.R. No. 834,107, 1981; (Chem. Abst. 95: 135651v) describes the pyrolytic production of olefins with peroxides present in a reactor, the internal surfaces of which have been pretreated with an aqueous alcoholic solution of boric acid. Coke formation is not mentioned in this patent since the function of the boric acid is to coat the inner surface of the reactor and thus decrease the scavenging of peroxide radicals by the reactor surface.
4. Starshov et al., *Neftekhimiya* 1979 (Chem. Abst: 92: 8645j) describes the effect of certain elements including boron on coke formation during the pyrolysis of hydrocarbons to produce olefins.

DESCRIPTION OF THE INVENTION

Generally the invention entails the use of certain boron compounds, and compositions containing such, to inhibit the formation and deposition of coke on surfaces in contact with a hydrocarbon (either in liquid or gaseous form) having a temperature of 600°–1300° F. While the method is applicable to any system where coke is produced, at the specified range of temperature and where the coke formed has a tendency to deposit on a surface such as a surface of a cracking catalyst (for example; zeolite, platinum, cobalt molybdenum, etc.) the method is particularly effective where the surface is composed of a ferrous metal. Iron, as well as iron alloys such as low and high carbon steel, and nickel-chromium-iron alloys are customarily used for the production of hydrocarbon processing equipment such as furnaces, transmission lines, reactors, heat exchangers, separation columns, fractionators, and the like. As earlier indicated, and depending upon the process being practiced, certain alloys within a given system are prone to coke deposition and the consequences thereof.

The present inventor discovered that coking may be significantly reduced on the iron-based and nickel-based surfaces of processing equipment by adding to the hydrocarbon feed stock or charge elemental boron, oxides of boron, boric acid, salts of boron oxides or metal borides, either neat or in compositions which vary depending upon the boron compound use.

The inventor discovered that certain peculiarities were evident in producing the particular compositions to be used. This aspect will be more comprehensively described later in this description. Suffice it to indicate at this point that the efficacy of formulations containing metal borides were not sensitive to the solvent or suspending medium as those formulations containing the boron oxide type compounds and boric acid.

The boron oxide compounds can be used as solids but are preferentially formulated using water and/or a non-polar solvent such as a light oil oil carrier. Boron oxides were not particularly effective when a highly polar organic solvent or suspending medium was utilized. Since boron oxide compounds are generally insoluble in the oil carrier, the composition is a completely dispersed suspension of the boron compound in the oil. It would appear, however, that if a particular oil was in fact capable of dissolving a given boron compound such would also be effective for the purpose. The boron compounds which are utilizable for the present purposes include any boron compound and even elemental boron. Illustrative of the boron oxide compounds are; alkyl borates, metaborates, e.g., sodium, potassium, lithium metaborates, triethyl borate, trimethyl borate; borate salts such as sodium tetraborate, potassium tetraborate, lithium tetraborate, etc. Also utilizable are such compounds as $BO_2$, $BO_6$, metal salts containing boron oxides $Na_2B_4O_7.10H_2O$, $K_2B_4O_7.10H_2O$, $K_2B_4O_7$, $LiBO_2$, $LiBO_2$, $LiBO_2XH_2O$, etc.

Metal borides, e.g., $TiB_2$, $ZrB_2$, $MgB_2$, $KB_6$, $SiB_6$, $SiB_4$, $SiB_3$, $W_2B+WB$, $AlB_2$, $AlB_{12}$, NiB, $LaB_6$, $ThB_4$, $B_2Se_3$; borides of materials like boron carbide, boron phosphide, boron nitride, boron halides, boron sulfide and ternary metal borides, for example MoAlB, $(Nb, Ta)_3B_2$, $Ce_2Ni_{21}B_6$; and also the use of the boron hydrides would represent a partial listing of useful materials. The preferred boride materials are the silicon borides and aluminum borides such as aluminum dodecarboride and silicon hexaboride because of their thermal stability (loss of boron 1500° C.).

As earlier generally indicated, in producing compositions of this invention certain critical precautions are to be followed depending upon the boron compound used.

If boric acid is used, the composition should be substantially free of water and organic polar solvents. Boric acid dissolved and/or dispersed in oil has been found to be quite effective. The solvents which may be used to formulate the boron oxide compounds or boric acid include paraffinic or aromatic hydrocarbons such as light oil, heavy aromatic naphtha, kerosene and the like. Generally any non-polar organic solvent should be acceptable for the purposes.

The suspending medium is in fact critical to the efficacy of the boron oxide type compounds since comparable formulations where the oil was replaced with alcohols or organic compounds with alcoholic functional groups, e.g., glycerine, ethylene glycol, Carbowax, etc., or with solvents that have high dielectric constants (polarity) such as dimethylforamide, dimethylsulfoxide and carboxylic acids, were totally ineffective and seemingly quite aggressive to the hot metal used for testing purposes.

The metal borides, however, were not as sensitive as the boric acid or boron oxide compounds since they can in fact be formulated with water, solvents having high dielectric constants such as alcoholic solutions and those mentioned in the preceding paragraph which were not suitable for boric acid or boron oxide compounds. However when the concentration of the polar liquid exceeds 10% by weight, the results appear to deteriorate, the only criteria being that the metal boride be, whatever medium is chosen, adequately suspended.

In the case of the boron oxide type compounds (including boric acid), the compounds may be suspended in a light oil carrier in any proportions, to produce a product which will provide the necessary amount of boron to any coke-formation-prone environment to effectively eliminate or in the least minimize such. Coking in some instances, for example in delayed coking operations, is a significant problem and if left untreated will eventually shut the operation down. Accordingly it would be desirable to assure that any product used is either high in boron content or if not high in boron content is fed to the charge at high dosage rates. Accordingly, product formulation lends itself to great flexibility.

Generally the product can contain on a weight basis from about 1 to 50%, with the remainder being the carrier, for example the light oil. To assure maintenance of the suspension during storage and exposure to different and perhaps drastic temperature conditions or to protect the suspension during transportation, various stabilizing agents may also be added to the formulation as well as any preservative which might be desirable.

The foregoing, although described in regards to boron oxide compounds, are equally applicable to those formulations containing metal borides with the exception of course that carrier systems other than paraffinic oils, e.g., glycerine, may be used.

The suspension stabilization agents that have been found to be effective are generally classified as organoclay rheological and thixotropic materials. One such material in this class of components is $Al_2O_3.SiO_2$ clay material commercially available as Benton SD-1. The concentration by weight of the rheological agent varies depending upon the type of boron compound being used. Normally, when formulating a 40% by weight boron-based component, the amount of rheological agent may vary between 0.5 to 6% by weight of formulation although the preferred range is 2 to 4% by weight.

When metal borides are used as the active boron compound, it is desirable to utilize some additional formulatory additives since the borides in some instances are difficult to keep suspended. It was discovered that inclusion of a halogen salt such as the alkaline earth metal (calcium, magnesium) and the $NH_4$ halides such as chlorides were helpful in maintenance of the suspension. Similarly, the use of organic materials such as high molecular weight succinimides was quite effective in keeping the boride in suspension. This type material is disclosed in U.S. Pat. Nos. 3,271,295, and 3,271,296 which are incorporated herein by reference.

While the halogen salts were found to aid in stabilizing the suspension, it was also determined that the cation of these salts, namely calcium, magnesium, lithium and ammonium, did in fact aid in the overall effect of the boron compound to inhibit coke formation and deposition.

While the above describes the use of the various agents; e.g., boron and boron compounds, surfactants, suspending agents, liquid mediums, etc. as single items in a given composition, it is contemplated that mixtures of the separate items may be used so long as they are compatible.

Typical formulations would be as follows:

| Ingredient | Percentage by Weight | | |
|---|---|---|---|
| | Actual | Range | Preferred Range |
| Boron Oxide Compound | | | |
| Boron oxide, Boron oxide compound or Boric Acid | 40 | 1–50 | 20–40 |
| Rheological Agent | 3 | 1–5 | 1–3 |
| Light Oil | 57 | 45–98 | 79–57 |
| Water may be substituted for the light oil in the Boron oxide composition | | | |
| Metal Boride | | | |
| Metal Boride (e.g., $SiB_6$) | 0.6 | 0.3 to 1 | 0.5 to 0.7 |
| Alkaline Earth or $NH_4$ Halogen-Salt | 0.75 | 0.1 to 1.5 | 0.5–1 |
| Optional Addition of Alkaline Earth or $NH_4$ Halogen-Salt | 0.75 | 0 to 1.5 | 0.5–1 |
| Organic Stabilization Agent | 30 | 0–40 | 25–35 |
| Light Paraffin Oil | 45 | 40–50 | 42–48 |
| Optional (High Dielectric Constant Liquid; e.g., Glycolic Acid, glycerin, etc.) | 2 | 0–10 | 1.5–2.5 |

The treatment dosages again are dependent upon the severity of the coking problem, location of such and of course the amount of boron based compound in the formulated product. Perhaps the best method of describing the treatment dosage would be based upon the actual amount of "boron" that should be added to the charge. Accordingly the amount of formulated product to be added to a charge should be such to provide 1 ppm to 8,000 ppm, and preferably 5 ppm to 1000 ppm, of boron to said hydrocarbon charge.

EXAMPLES

In order to establish the efficacy of the inventive concept various tests were conducted utilizing a number of hydrocarbon stock and feeds. The test procedure utilized was as follows:

In a glass reaction vessel, equipped with a metal stirring blade, a thermocouple, a reflux condenser, and a nichrome wire (0.51 mm thick and 95 mm long) designated Chromel A mounted between two brass rods 50 mm apart, were placed 500 grams of coker feedstock. A heating mantle was used to heat the feedstock to 450° F. with stirring. When this temperature was reached, the additive, if any, was added and the mixture stirred 30 minutes. Power (20 amps, 7.25–7.30 volts; this amount varying depending on the feedstock) was then applied to the wire. An adjustment was made to bring the current to 20.5 amps after 30 minutes. After the power was on for one (1) hour, the temperature of the reactor mixture was 650° F., which stayed at about this temperature for the next 23 hrs. At the end of 24 hours, the power was turned off and the reaction was cooled to 230° F., the wire removed, washed carefully and thoroughly with xylene, allowed to dry, and weighed.

The hydrocarbon stock used for the following testing is described as Coke Feedstock A.

EXAMPLE 1

With no additive, the average amount of coke on the wire was 440 mg.

EXAMPLE 2

Example 1 was repeated except 5 g. of mineral oil (of saybolt viscosity 125°–135°/100° F.) was added. The coke yield amounted to 454 mg. This example shows that the mineral oil did not affect the reaction.

EXAMPLE 3

Example 1 was repeated except 5 g of 10 wt % $CaB_6$ suspended in mineral oil was added. A total average of 63 mg of coke resulted, showing a 86% protection by the boride.

EXAMPLE 4

Example 3 was repeated except 5 g $SiB_6$+Si is used in place of $CaB_6$. Only 215 mg of coke resulted or 51% protection.

EXAMPLE 5

Example 1 was repeated using dosages within the range of 2–5 g of $B_2O_3$ (40 wt % suspended with 3 wt % rheological agent composed of $Al_2O_3.SiO_2$ clay in 57 wt % mineral oil) were used. The coke weight averaged 68 mg for a 85% protection.

EXAMPLE 6

(a) Example 2 was repeated except 2 g glycerine was used. The wire broke three hours into the reaction. After the 3 hours, 361 mg of coke had accumulated.

(b) When the same reaction was repeated but with 2.5 g of 10 wt % $B_2O_3$ in glycerine (155 ppm B), the wire again broke after only 1 hour of reaction time and 169 mg of coke had accumulated. It appears the wire corroded thru due to the corrosive action of glycerine and that glycerine cannot be used.

EXAMPLE 7

(a) Example 2 was repeated except 4 g of DMF was used instead of mineral oil. The resulting large amount of coke (847 mg) indicates DMF promotes coking.

(b) When this experiment was repeated using 2.0 g of 10 wt % $H_3BO_3$ in DMF (70 ppm B), 2300 mg of coke resulted, indicating the $H_3BO_3$ did not counteract the coke promoting of DMF.

(c) In another run with 2 g of 30 wt % $H_3BO_3$ in methyl pyrrolidone (another amide solvent) (210 ppm B), 581 mg of coke accumulated before the wire broke.

EXAMPLE 8

When Example 1 was repeated using 2.5 g of 5 wt % $LiBO_2$ in Carbowax 400 (155 ppm B), 505 mg coke resulted.

EXAMPLE 9

The test procedure outlined above was repeated utilizing a different hydrocarbon stock (Coke Feedstock B) without treatment. The amount of coke deposited averaged 547 mg in seven tests.

EXAMPLE 10

The composition as described in Example 5 was tested in accordance with the procedure using the stock described in Example 9. An average of 142 mg of coke deposited on the wire representing an average of 74% protection.

EXAMPLE 11

Example 10 was repeated with the exception that $H_3BO_3$ was substituted for Example 10's $B_2O_3$. An average of 255 mg of coke deposited what represented an average of 52% protection.

EXAMPLE 12

The test procedure outlined above was repeated utilizing yet another hydrocarbon stock (Coke Feedstock C) without treatment. An average of seven hundred forty one (741 mg) mg of coke deposited in three tests.

EXAMPLE 13

Example 5 was repeated utilizing the hydrocarbon stock described in Example 12. A reduction of coke formation to an average 210 mg was observed providing a 71% solution.

The test results obtained in accordance with the above described, are set forth collectively in the following TABLE I.

TABLE I

| Example | Additive | Av. Wt. of Coke Deposit (mg) | Av. Percent Protection | Number of Tests Conducted to Arrive at Av. |
|---|---|---|---|---|
| 1 | None | 440 | — | 5 |
| 2 | Mineral Oil | 454 | 0 | 1 |
| 3 | $CaB_6$ in Oil (660 ppm B) | 63 | 86 | 3 |
| 4 | $SiB_6$ + Si in Oil (665 ppm B) | 215 | 51 | 1 |
| 5 | $B_2O_3$ in Oil | (52–85) 68 Av. | (81–88) 85 Av. | 8 (ppm B 1600–4000) |
| 6 (a) | Glycerine | 361* | — | 1 |
| 6 (b) | $B_2O_3$ + Glycerine | 169* | — | 1 |
| 7 (a) | DMF (Dimethyl Foramide) | 847 | −55% | 1 |
| 7 (b) | $H_3BO_3$ in Methyl Pyrrol. | 581* | — | 1 |
| 7 (c) | $H_2BO_3$ + DMF | 2300 | — | 1 |
| 8 | $LiBO_2$ in Carbowax 400 | 505 | — | 1 |
| 9 | None (Coke Feedstock B) | 547 | — | 7 |
| 10 | $B_2O_3$ in Oil | (107–178) Av. 142 | (67–80) Av. 74 | 5 |
| 11 | $H_3BO_3$ in Oil | (210–299) Av. 255 | (42–62) Av. 52 | 3 |
| 12 | None (Coke Feedstock C) | 741 | — | 3 |
| 13 | $B_2O_3$ + Oil | (188–234) Av.1210 | (68–75) Av. 71 | 5 |

*Wire broke before test completed.

Table II sets forth the specific data determined for Examples 1, 5, 9, 10, 11, 12 and 13.

Product A was formulated on a weight basis to contain:

40% $B_2O_3$
3% Rheological agent (Bentone SD-1($Al_2O_3.SiO_2$ clay))
57% Light mineral oil
Product B
40% $H_3BO_3$
3% Bentone SD-1
57% light mineral oil

TABLE II

| | SAMPLE | TREATMENT(ppm) | % ACTIVE(ppm) | WEIGHT DEPOSIT (mg) | % PROTECTION |
|---|---|---|---|---|---|
| | | | Coke Feedstock A | | |
| | Blank | — | — | 446.9 | — |
| | " | — | — | 449.8 | — |
| 439.7 avg | " | — | — | 446.3 | — |
| | " | — | — | 421.5 | — |
| | " | — | — | 435.3 | — |
| | Product A | 6,400 | 2,560 | 66.4 | 85.0 |
| | " | 6,400 | 2,560 | 66.3 | 85.0 |
| | " | 6,400 | 2,560 | 63.8 | 86.0 |
| | " | 6,000 | 2,400 | 86.3 | 81.0 |
| | " | 4,000 | 1,600 | 89.4 | 80.0 |
| | " | " | " | 75.3 | 83.0 |
| | " | 8,000 | 3,200 | 52.4 | 88.0 |
| | " | 10,000 | 4,000 | 85.3 | 81.0 |
| | | | Coke Feedstock B | | |
| | Blank | — | — | 563.8 | — |
| | " | — | — | 497.8 | — |
| | " | — | — | 535.4 | — |
| 546.7 avg | " | — | — | 558.8 | — |
| | " | — | — | 511.7 | — |
| | " | — | — | 563.3 | — |
| | " | — | — | 596.0 | — |
| | Product A | 10,000 | 4,000 | 158.2 | 71.0 |

TABLE II-continued

| SAMPLE | TREATMENT(ppm) | % ACTIVE(ppm) | WEIGHT DEPOSIT (mg) | % PROTECTION |
|---|---|---|---|---|
| " | " | " | 128.2 | 77.0 |
| " | 7,200 | 2,880 | 177.8 | 68.0 |
| " | 8,000 | 3,200 | 146.0 | 73.3 |
| " | 6,000 | 2,400 | 106.6 | 80.5 |
| " | 8,000 | 3,200 | 119.5 | 78.0 |
| " | " | " | 154.3 | 72.0 |
| " | 5,000 | 2,000 | 115.3 | 79.0 |
| " | 8,000 | 3,200 | 165.0 | 70.0 |
| Product B | 20,000 | 8,000 | 209.6 | 62.6 |
| " | 10,000 | 4,000 | 247.2 | 54.7 |
| " | 6,000 | 2,400 | 299.3 | 45.3 |
| | | Coker Feedstock C | | |
| Blank | — | — | 695.0 | — |
| " | — | — | 732.7 | — |
| 740.9 avg " | — | — | 795.0 | — |
| Product A | 20,000 | 8,000 | 195.7 | 74.0 |
| " | 7,000 | 2,800 | 205.3 | 72.0 |
| " | 20,000 | 8,000 | 247.9 | 67.0 |
| " | 8,000 | 3,200 | 233.8 | 69.0 |
| " | 11,000 | 4,400 | 187.5 | 75.0 |

Various tests were conducted to establish the effect, if any, of utilizing water or a solvent for the active boron compounds such as $B_2O_3$ and $H_3BO_3$. Various feedstocks were used. The results of the test are recorded in TABLE III. The test procedure utilized was that described earlier.

TABLE III

| Grams of Solution Added | wt % $B_2O_3$ in $H_2O$ | mg coke formed | % Protection |
|---|---|---|---|
| | Coke Feedstock G | | |
| 0 | 0(blank) | 105 | — |
| 3 | 15% | 84.1 | 20 |
| 5 | 15% | 66.8 | 36 |
| 5 | 15% | 67.3 | 36 |
| | Coke Feedstock H | | |
| 0 | 0(blank) | 58.0 | — |
| 5 | 20% | 24.6 | 56 |

Five runs with 20% $H_3BO_3$ in water gave the same results as the blank, which is the average of five runs. Analysis of the coker feedstock after reaction showed boron to be present.

The results establish that while the $B_2O_3$ water compositions were not as effective as the $B_2O_3$ contained in oil, the compositions were in fact effective.

The $H_3BO_3$/water compositions were not effective at all contrary to what would be expected from the Starshov et al (1977) article listed earlier in this specification.

EXAMPLE 14

Example 1 was repeated except that the wire used was iron (low carbon steel) and power settings were 35 amps and 3.4 volts. The additives were added neat (no solvents). Coker Feedstock F was used for these runs. With no treatment, Coker Feedstock provided on 12 gauge were 621 mg of coke, and for 13 gauge were 299.

| Additive | g used | wire gauge | ppm compound | ppm B | mg coke | % protection |
|---|---|---|---|---|---|---|
| $B_2O_3$ | 0.6 | 12 | 1200 | 372 | 186 | 70 |
| $B_2O_3$ | 1.0 | 12 | 2000 | 620 | 86 | 86 |
| $AlB_{12}$ | 0.6 | 13 | 1200 | 993 | 164 | 45 |

-continued

| Additive | g used | wire gauge | ppm compound | ppm B | mg coke | % protection |
|---|---|---|---|---|---|---|
| $W_2B$ + WB | 0.6 | 13 | 1200 | ca. 46 | 172 | 42 |
| $W_2B$ + WB | 0.6 | 13 | 1200 | ca. 46 | 182 | 39 |

EXAMPLE 15

Example 1 was repeated but the additive was a suspension prepared by mixing 10 wt % $SiB_6+Si_{0.16}$, 10 wt % glycerine, 35 wt % calcium naphthenate, 43 wt % mineral oil, 1 wt % magnesium chloride, and 1 wt % calcium chloride, (Product E). Coker feedstock K tested without treatment gave 1820 mg of coke on nichrome wire.

| Coker Feedstock | g product | ppm SiB | ppm B | mg coke | % protection |
|---|---|---|---|---|---|
| Product E | 17 | 3400 | 2261 | 1352 | 26 |
| Product E | 17 | 3400 | 2261 | 1350 | 26 |

$$\% \text{ protection} = \frac{\text{mg coke for blank} - \text{mg coke with additive}}{\text{mg coke for blank}} \times 100$$

I claim:

1. A process for inhibiting the formation and deposition of filamentous coke on metallic surfaces in contact with a hydrocarbon having a temperature of 600°-1300° F. which comprises adding to said hydrocarbon a sufficient amount for the purpose of a boron compound selected from the group of boron oxide compounds, boric acid and metal borides, with the proviso that when boric acid is used, it is substantially free of water.

2. A method according to claim 1 wherein the boron compound is added to said hydrocarbon prior to its having a temperature of 600°-1300° F.

3. A method according to claim 2 wherein the hydrocarbon has a temperature of 850° to 1100° F.

4. A method according to claim 1 wherein the hydrocarbon has a temperature of 850° to 1100° F.

5. A method according to claim 1 wherein said boron compound is in a non-polar organic liquid.

6. A method according to claim 5 wherein said boron compound is a boron oxide compound in a non-polar organic liquid.

7. A method according to claim 6 wherein the boron oxide compound is added to said hydrocarbon in an effective amount for the purpose and in an amount to assure from about 1 to 8,000 parts per million parts of hydrocarbon charge.

8. A method according to claim 1 wherein the surfaces are ferrous metal surfaces.

9. A method according to claim 8 wherein the boron compound is in a non-polar liquid.

10. A method according to claim 9 wherein the boron compound is added to said hydrocarbon prior to its having a temperature of 600°-1300° F.

11. A method according to claim 10 wherein the hydrocarbon has a temperature of 850° to 1100° F.

12. A method according to claim 11 wherein the hydrocarbon has a temperature of 850° to 1100° F.

13. A method according to claim 8 wherein the boron compound is boric acid.

14. A method according to claim 8 wherein said boron compound is a metal boride dispersed in a non-polar organic liquid.

15. A method according to claim 9 wherein said boron compound is a boron oxide compound in a non-polar organic liquid.

16. A method according to claim 15 wherein the boron compound is added to said hydrocarbon in an effective amount for the purpose and in an amount to assure from about 1 to 8,000 parts per million parts of hydrocarbon change.

17. In a method for producing coke wherein:

(i) a hydrocarbon is charged into a zone and brought to a temperature of from about 800°-1300° F. to remove and recover in a separation zone any products which are volatilized from and/or formed in said hydrocarbon when heated to said temperature, (ii) the remainder of said hydrocarbon is transferred through transfer lines to a coke-forming area where such is cooled to form coke, and (iii) wherein undesired premature coke formation and deposition is normally experienced on the surfaces of said heating zone, products separation zone or transfer lines, the improvement being:

adding to said hydrocarbon a sufficient amount of a boron compound selected from the group consisting of boron oxide compounds, boric acid and metal borides to effectively inhibit the premature formation and deposition of the undesired filamentous coke in said heating zone, transfer lines and/or volatile or product separation zone, further with the proviso that when used in said method said boric acid is substantially free of water.

18. A method according to claim 17, wherein the hydrocarbon charge is selected from the group of crude oils, shale oil, athabasca bitumen, gilsonite, coal tar pitch, asphalt, aromatic stocks and refractory stocks.

19. A method according to claim 18 wherein the heating zone, the separation zone and/or transfer lines are composed of a ferrous-metal.

20. A method according to claim 19 wherein the boron compound is boric acid in a composition which is essentially free of water.

21. A method according to claim 18 wherein the boron compound is a boron oxide compound in a non-polar liquid.

22. A method according to claim 21 wherein the boron compound is dispersed in a light oil carrier to form a suspension.

23. A method according to claim 22 wherein the suspension contains a rheological agent suitable for maintaining the boron oxide dispersed.

24. A method according to claim 21 wherein the boron compound is added to said hydrocarbon charge in an amount to insure from about 1 to 8000 parts of boron per part of hydrocarbon change.

25. A method according to claim 22 wherein the boron compound is added to said hydrocarbon charge in an amount to insure of from about 1 to 8000 parts of boron per part of hydrocarbon change.

26. A method according to claim 19 wherein the boron compound is a metal boride.

27. A method according to claim 26 wherein the metal boride is an aluminum boride or a silicon boride.

28. A method according to claim 26 wherein the metal boride is dispersed in a light oil to form a suspension.

29. A method according to claim 28 wherein the suspension additionally contains a suitable amount of at least one ingredient selected from the group consisting of alkaline earth and ammonium halogen salts, an organic stabilizing agent and a high dielectric solvent.

* * * * *